US005591065A

United States Patent [19]

Mizuno et al.

[11] Patent Number: 5,591,065

[45] Date of Patent: Jan. 7, 1997

[54] METHOD OF DRESSING HONING WHEELS

[75] Inventors: Sadao Mizuno, Nagoya; Akinori Hoshino, Chiryu; Akira Muraoka, Toyama; Hiroyuki Takahashi, Shinminato, all of Japan

[73] Assignees: Aisin Seiki Kabushiki Kaisha, Aichi-ken; Nachi-Fujikoshi Corp., Toyama-ken, both of Japan

[21] Appl. No.: 625,092

[22] Filed: Apr. 1, 1996

Related U.S. Application Data

[63] Continuation of Ser. No. 209,476, Mar. 14, 1994, abandoned.

[30] Foreign Application Priority Data

Mar. 17, 1993 [JP] Japan ..... 5-056991

[51] Int. Cl.[6] ..... B24B 1/00

[52] U.S. Cl. ..... 451/47; 451/61; 451/51; 451/180; 451/218; 451/242

[58] Field of Search ..... 451/51, 52, 54, 451/56, 59, 61, 47, 180, 182, 213, 215, 218, 219, 221, 246, 242, 245

[56] References Cited

U.S. PATENT DOCUMENTS

| | | | |
|---|---|---|---|
| 2,647,346 | 8/1953 | Conradson | 451/221 |
| 2,647,348 | 8/1953 | Hahn | 451/218 |
| 2,818,687 | 1/1958 | Quimby | 451/218 |
| 2,824,412 | 2/1958 | Parker | 451/218 |
| 2,826,875 | 3/1958 | Townsend | 451/218 |
| 2,923,106 | 2/1960 | Reusser | 451/218 |
| 4,085,554 | 4/1978 | Sugita | 451/56 |
| 4,095,377 | 6/1978 | Sugita | 451/51 |
| 4,866,887 | 9/1989 | Imai et al. | 451/56 |
| 4,989,377 | 2/1991 | Junker | 451/221 |

OTHER PUBLICATIONS

*Fässler* D–250–C, "Gear Honing Machine," Specification Sheet.

*Primary Examiner*—James G. Smith
*Assistant Examiner*—Eileen P. Morgan
*Attorney, Agent, or Firm*—Hazel & Thomas, P.C.

[57] ABSTRACT

The present invention relates to a method for dressing a hone of a honing wheel which is used for honing a gear to be finished. A dressing tool is brought into contact with the honing wheel under a predetermined constant contact pressure and during the reciprocal feed of the dressing tool. The amount of the contact pressure is maintained constant so as to gradually increase the in-feed of the honing wheel. This is useful in decreasing the number of transverse feeds of the dressing tool.

2 Claims, 7 Drawing Sheets

METHOD OF DRESSING HONING WHEELS

This application is a continuation of application Ser. No. 08/209,476, filed Mar. 14, 1994 now abandoned.

BACKGROUND OF THE INVENTION

Field of the Invention

The present invention relates to a method of dressing a honing wheel which is brought into contact with a dressing tool carried on a gear cutting machine.

For the purpose of ensuring highly precise geometry of gear teeth to be used in various applications including automobiles, the gear teeth are subjected to a honing finish step alter completing a gear cutting operation with a gear cutting machine. The conventional gear cutting machine incorporating a honing wheel is sold under the trade name of Fassler D-250-C. This has a construction such as that shown in FIG. 1 wherein a gear 4 to be finished is arranged between a head stock 31 and a tail stock 32 on a worktable 3 in such a manner that an axis of head stock 31 is co-linear with an axis of the tail stock 32 and the gear 4 is rotatably carried on both centers 41, 42. A honing wheel 1 is at an incline arranged with respect to the axis of stocks 31, 32, and at an inclination angle θ. Honing wheel 1 can be rotated by a power source to permit the honing of gear teeth (not shown) of a gear 4 carried on the stocks 31, 32 as will be explained further below in connection with the embodiment of the present invention.

For the honing finish operation of the gear teeth (not shown) by means of the honing wheel 1, a hone (not shown) is secured to an inner surface of honing wheel 1. The hone (not shown) and honing wheel 1 are brought into contact with the gear 4 until for example a total honing in-feed, i.e., distance of travel, amounts to 1–2 μm while the honing wheel 1 is rotated and fed against gear 4. The hone (not shown) becomes considerably worn after the honing finish operation of a large number of the gears 4, and eventually highly precise gear teeth cannot be obtained using that hone.

After considerable wear of the hone beyond a predetermined amount, the honing wheel 1 must be provided with a replacement hone (not shown). However, a new hone (not shown) may not be satisfactory in the accuracy of its size. Consequently, a dressing, i.e., sizing operation, is required to precisely size the new hone (not shown).

The dressing operation is performed by a dressing ring 5 which serves to dress an inner surface (not shown) of the hone (not shown) and a dressing gear 6 which serves to dress the surfaces of the hone (not shown) corresponding to the gear teeth (not shown) of the gear 4 (refer to FIGS. 2 and 6). A conventional method of dressing a hone is composed of the following steps.

The steps of the dressing the new hone (not shown) in the honing wheel 1 using the dressing 5 and the dressing gear 6 collectively as a dressing tool 5 or 6 are illustrated in FIGS. 2 and 6. A spindle 15 with the ring 5 is substituted for the gear 4 between both the centers 41, 42 and the worktable 3 is reciprocally traversed along a bed so as to locate the ring 5 inside the honing wheel 1. Referring to FIGS. 4 and 5, the inner surface (not shown) of the hone (not shown) in the honing wheel 1 is brought into contact with the dressing ring 5 to dress the inner surface (not shown) of the hone (not shown) by rotating the honing wheel 1 and feeding dressing tool 5 or 6 against the inner surface of the honing wheel 1.

Referring to FIG. 11, individual in-feed and transverse feed steps for dressing the honing wheel 1 and the dressing ring 5 are illustrated. At each end of the transverse feed stroke of the worktable 3, the in-feed step of honing wheel 1 toward and against dressing ring 5 is carried out. For example, if a total dressing in-feed is 2.5 μm, five individual in-feeding steps for each 0.5 μm are performed. It is noted that in this approach, constant in-feed steps of small values are employed. After dressing the inner surface of the hone in the honing wheel 1, and as shown in FIGS. 6 and 7, a spindle 16 with the dressing gear 6 is substituted for the spindle 15 on the worktable 3 for the purpose of dressing the surfaces of the hone corresponding to gear teeth of the gear 4 to be honed. The in-feed steps, when moving honing wheel 1 against dressing gear 6, are carried out in the same manner as the steps for in-feeding the dressing ring 5 as mentioned above, namely, the in-feeding of the honing wheel 1 to the dressing gear 6 is subdivided into several individual in-feed steps in which honing wheel 1 moves in constant, small distances (see FIG. 11).

The completion of the dressing of the honing wheel 1 will lead to the honing finish operation of a new work, namely, gear 4 (refer to FIGS. 8 and 9).

This conventional approach to dressing the hone in the honing wheel 1 is based on the concept that the in-feeding of honing wheel 1 toward the dressing ring 5 or dressing gear 6 is subdivided into several individual in-feed steps by moving honing wheel 1 a constant small distance at the end of each transverse stroke of the dressing tool 5 or 6. In order to prevent the breaking of the hone (not shown) in the honing wheel 1, the amount of each in-feed is limited to a small value, for example, a value of 0.5 μm, which is smaller than a maximum permissible value of the elastic deformation of a hone (not shown) to be dressed. Because of the relatively small distance moved by honing wheel 1 during each in-feed step, the previously described conventional approach results in a large number of reciprocal movements of the dressing tool 5 or 6, and prolongs the working time required to dress a honing wheel 1.

SUMMARY OF THE INVENTION

Accordingly, it is an object of the present invention to provide a method for dressing a hone in a honing wheel, which eliminates the drawbacks of the prior art.

It is a further object of the present invention to provide a method of dressing a hone in a honing wheel by an abutting force which is maintained between the dressing tool and the honing wheel 1 during reciprocal movement of the dressing tool. In implementing this process, the distance of each in-feed is gradually increased from the start point of the reciprocal feed of the dressing tool to the turn point.

According to the present invention, a method for honing a honing wheel is provided wherein increasing the in-feed distance increases the in-feed of a dressing tool, for each transverse movement of the dressing tool thereby increasing the amount of material removed by the dressing tool for each stroke resulting in a decrease in a total working time for dressing each hone.

BRIEF DESCRIPTION OF THE DRAWINGS

These and other features of the invention will be understood by way of the embodiment with reference to the accompanying drawings, in which.

DETAILED DESCRIPTION OF THE PREFERRED EMBODIMENT

A gear cutting machine as illustrated in FIGS. 1–9 will be used for carrying out one embodiment of the present invention wherein adjustment of the in-feed distance for a honing wheel (refer to FIG. 10) is implemented. Any discussion as to how to operate this gear cutting machine and also dress a honing wheel 1 by means of a dressing ring 5 and gear 6 referred to collectively as a dressing tool 5 or 6 previously set forth will be omitted hereinafter.

Figure 1:
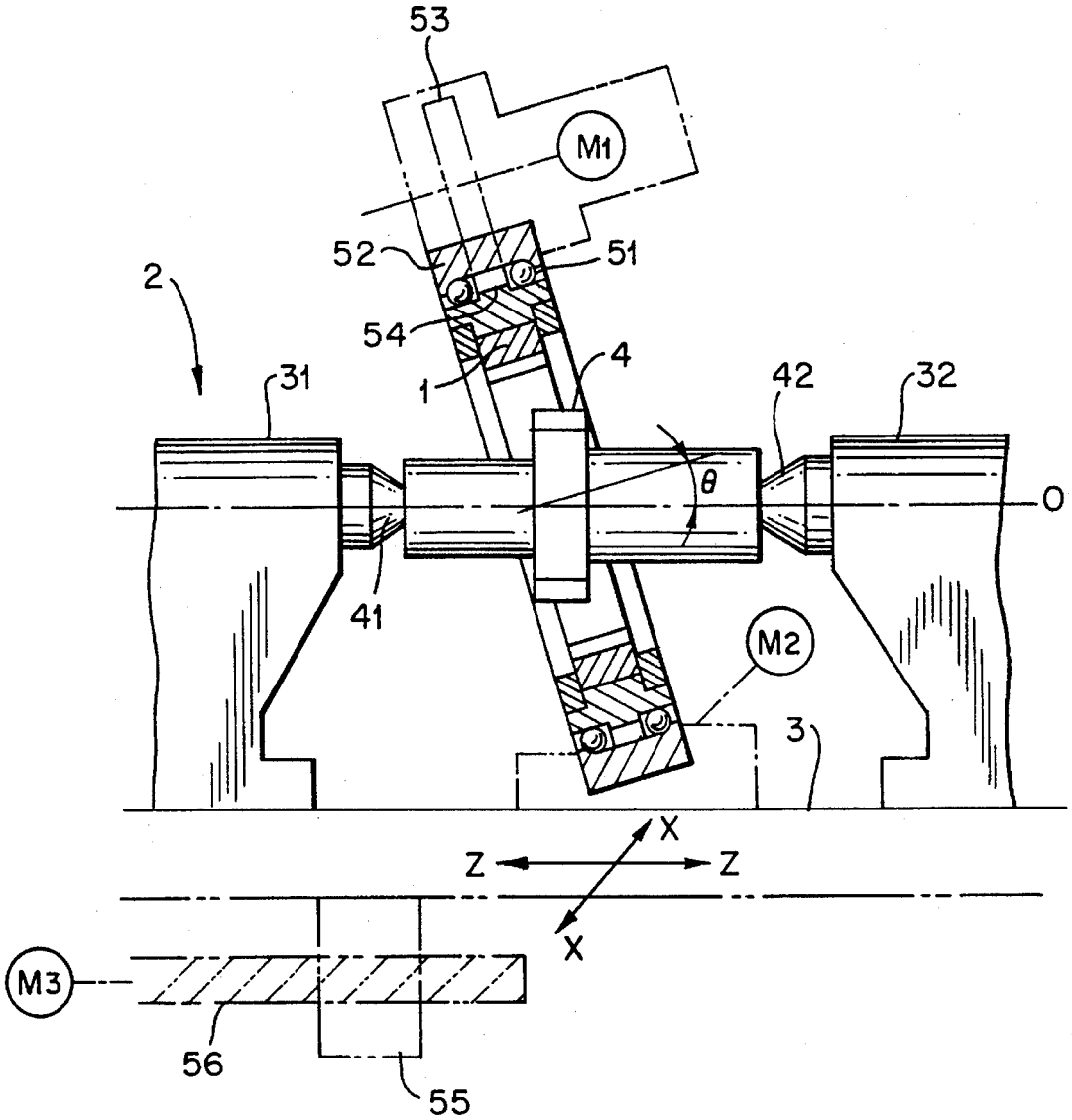
FIG. 1 is a side view showing a part of a gear cutting machine consistent with a Fässler D-250-C and applicable to the present invention.
Figure 2:
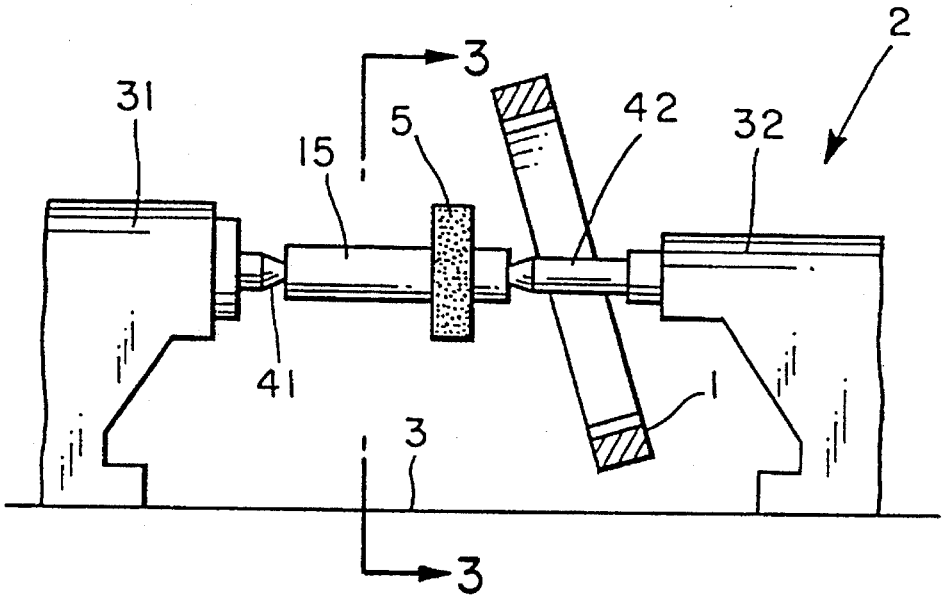
FIG. 2 is a view showing a dressing ring in a gear cutting machine applicable to the present invention.
Figure 3:
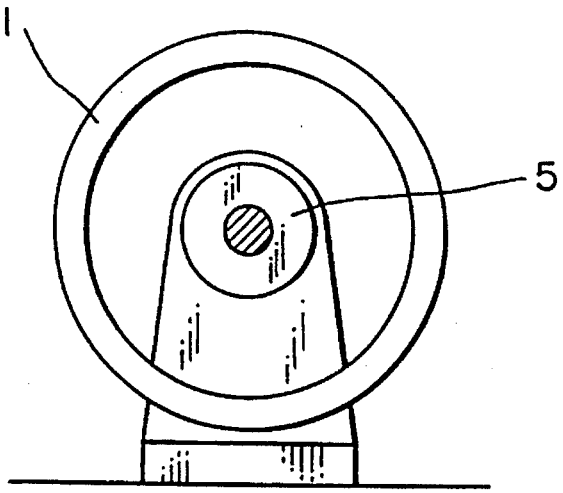
FIG. 3 is a side view taken along a sectional line 3—3 shown in FIG. 2.
Figure 4:
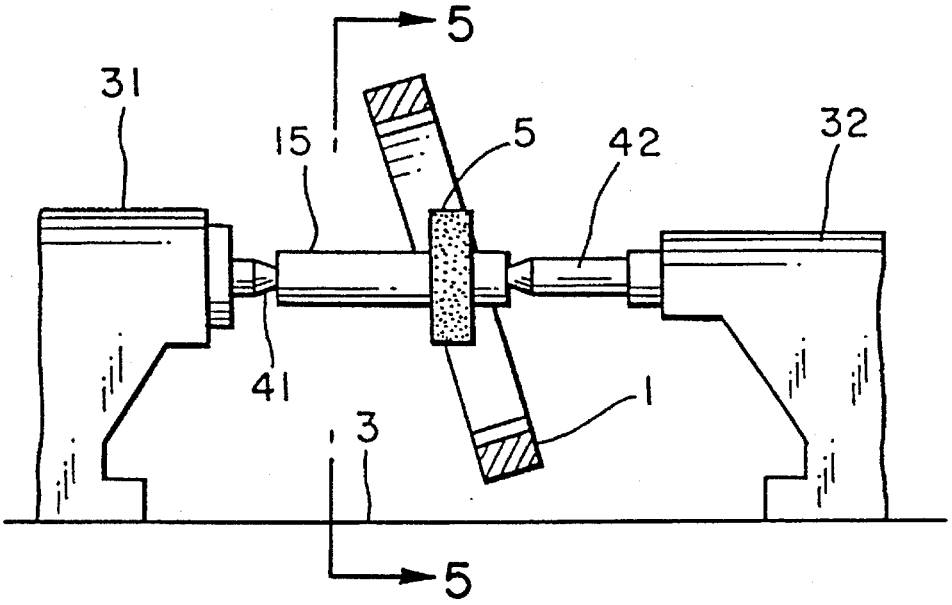
FIG. 4 is a view showing a honing wheel in contact with a dressing ring.
Figure 5:
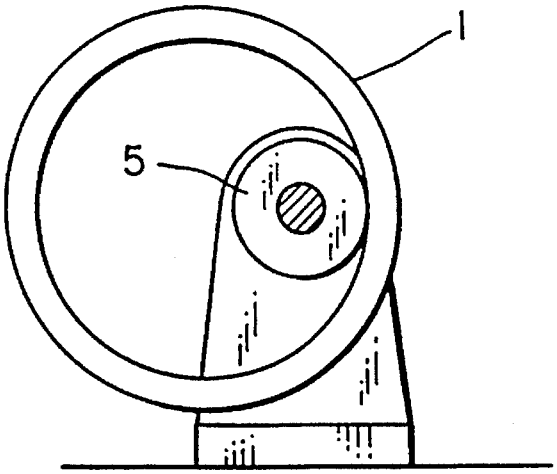
FIG. 5 is a side view taken along a sectional line 5—5 shown in FIG. 4.
Figure 6:
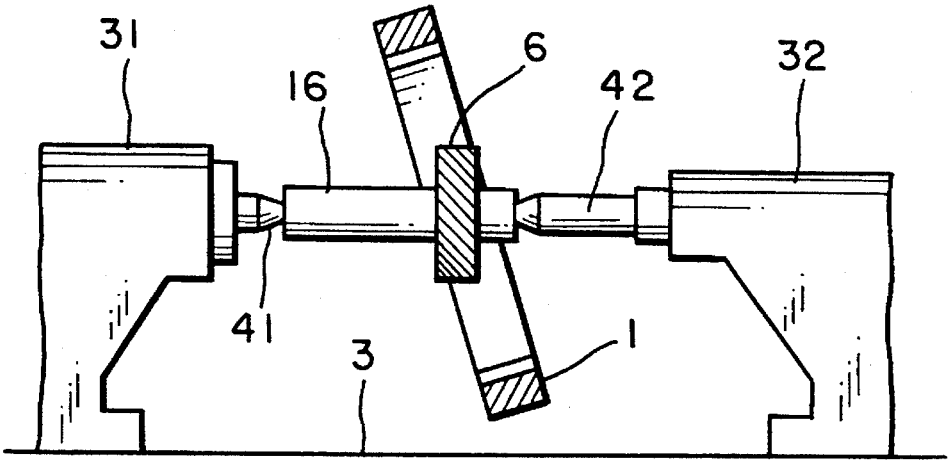
FIG. 6 is a side view showing a honing wheel and another dressing gear applicable to the present invention.
Figure 7:
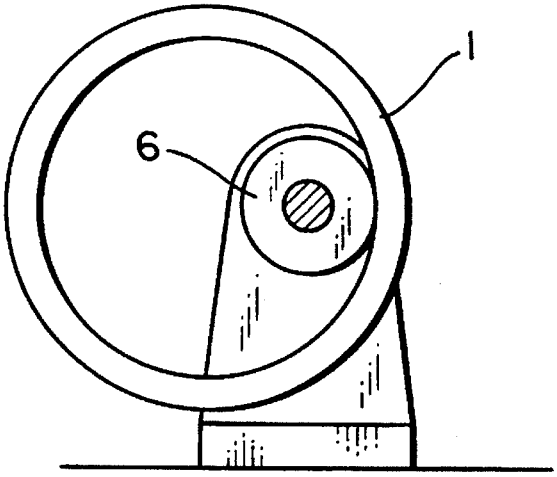
FIG. 7 is a view showing the contact relationship between a honing wheel and another dressing gear in contact with each other.
Figure 8:
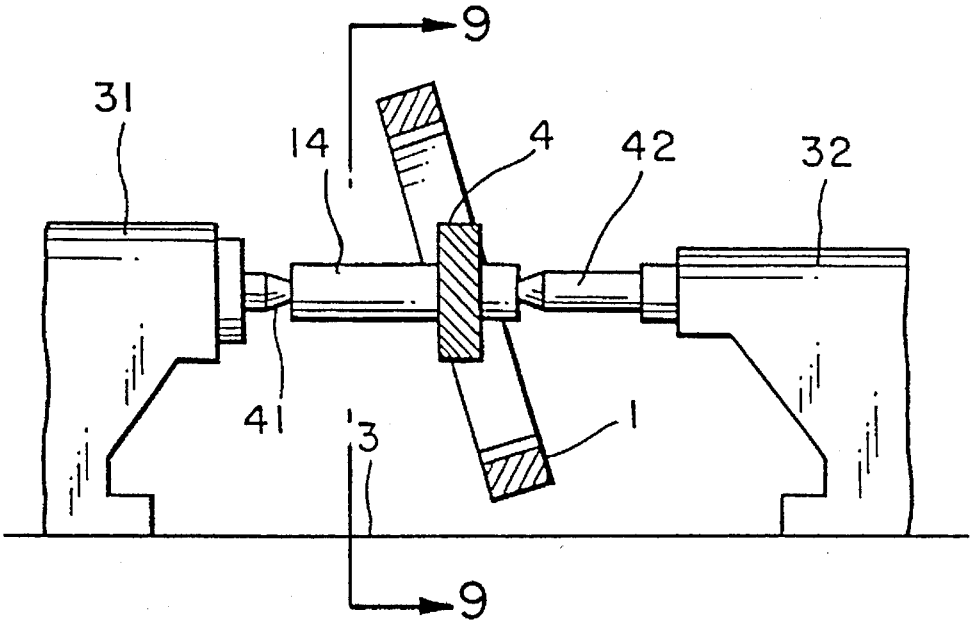
FIG. 8 is a side view showing a gear to be honed and a honing wheel applicable to the present invention.
Figure 9:
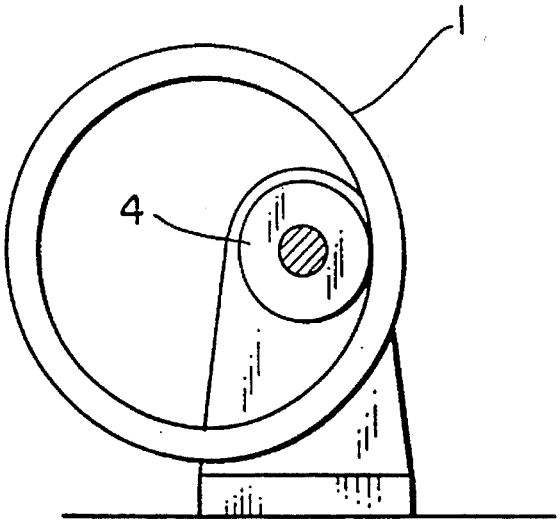
FIG. 9 is a view taken along a sectional line 9—9 shown in FIG. 8.

Referring to FIG. 1, in accordance with the operation of a Fässler D-250-C, the honing wheel 1 is rotatably surrounded by a casing 52 through a bearing means 51 and rotated by a first motor M1 mounted on the casing 52 through a gear 53 which engages with an outer ring gear 54 of the honing wheel 1.

The casing 52 is movable in the direction of X—X by a second motor M2 with respect to the table 3. The table 3 is reciprocated by a third motor M3 and a nut-screw rod means 55, 56 in the direction of Z—Z. The tool 5 or 6 may be rotated with the honing wheel 1.

The rotation of the second motor M2 causes the casing 52 and the honing wheel 1 to access the gear 4 or tool 5 or 6 by moving the casing 52 toward the gear 4 or tool 5 or 6 in the direction of X—X. This movement of the casing 52 serves to maintain and establish constant contact pressure between the hone and the tool in order to provide a gradually increased in-feed stage (see FIG. 10). The movement of the casing 52 may be controlled by adjustment of electrical current flow supplied to the motor M2.

Figure 10:
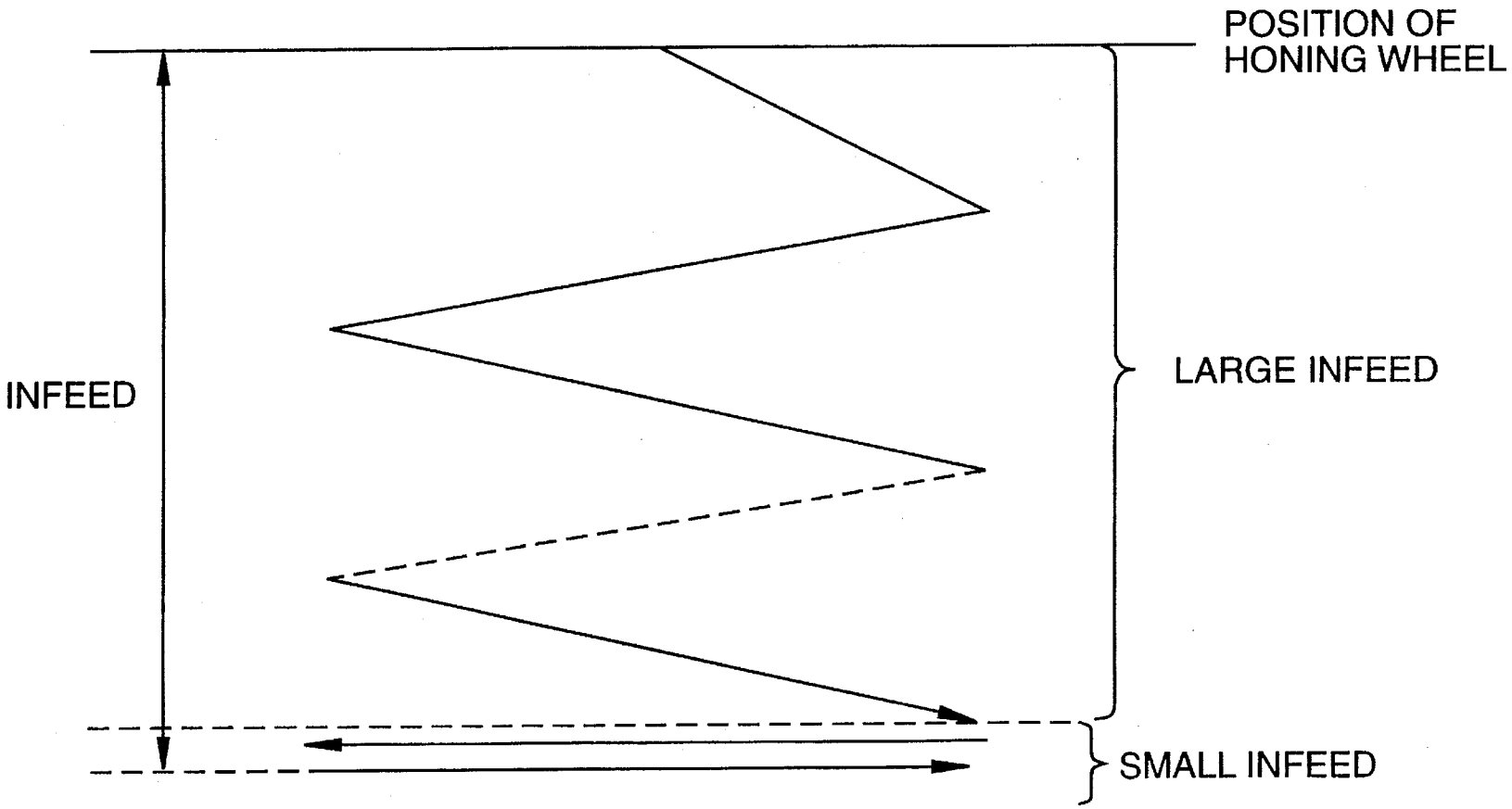
FIG. 10 shows a graphical illustration of the relationship between a transverse stroke of a dressing tool and an in-feed step of a honing wheel according to the present invention.
Figure 11:
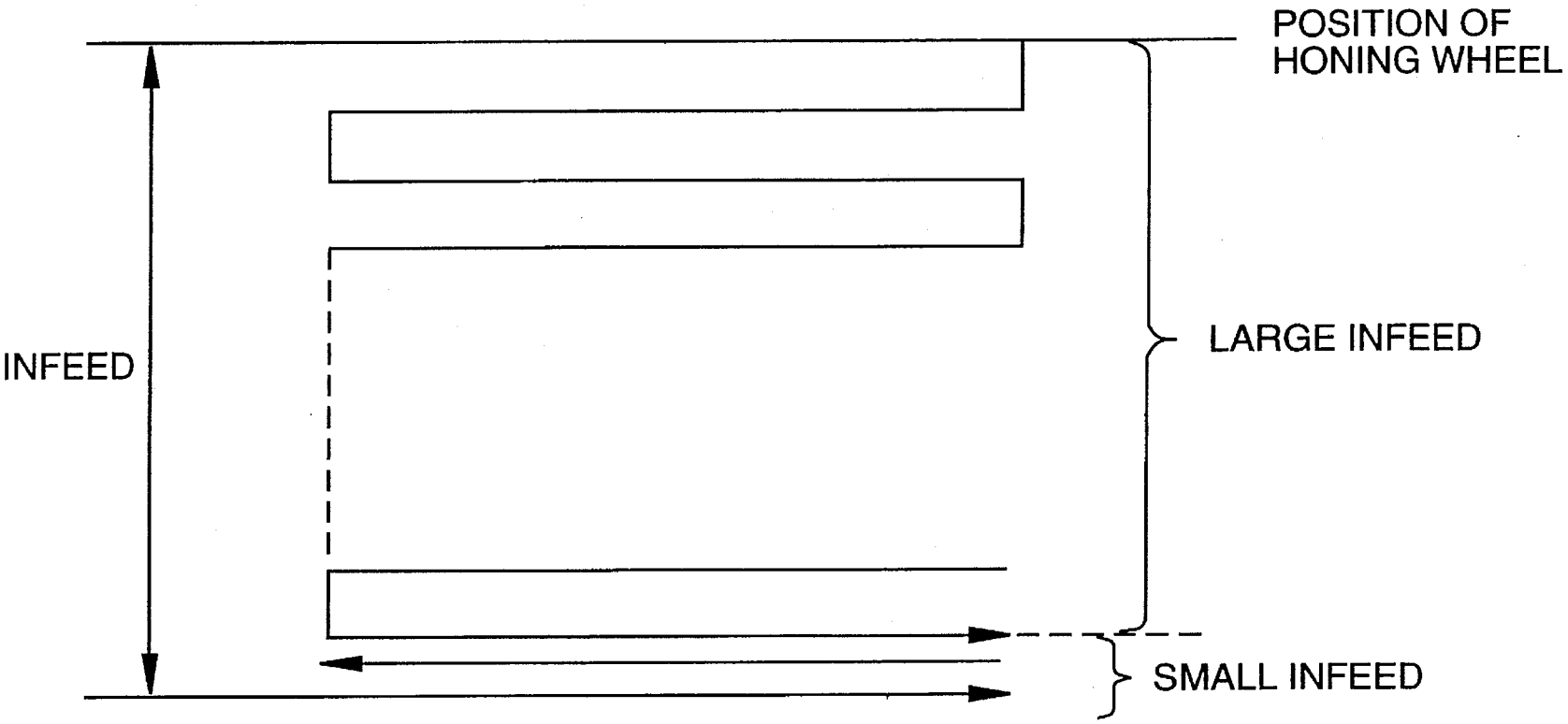
FIG. 11 PRIOR ART
FIG. 11 is a graphical illustration showing the relationship between a transverse stroke of a dressing tool and an in-feed stroke of a honing wheel according to the prior art.

Referring to FIG. 10, wherein the relationship between a transverse stroke of each of a dressing ring 5 and dressing gear 6 and an in-feed of a honing wheel 1 is graphically illustrated according to the present invention. As shown, an in-feed of honing wheel 1 which is rotated by a first motor M1 (See FIG. 1) is gradually increased by feeding the honing wheel 1 with the casing 52 in response to an amount of rotation of the second motor M2 in the in-feed direction during a reciprocating movement of the table 3 in the transverse-feed direction. The movement of the casing 52 in the in-feed direction may be controlled by an electrical current flow supplied to the second motor M2. As the result, as each in-feed distance increases, a depth of cut through a surface of honing wheel 1 increases. When compared to conventional methods, more material is removed from honing wheel 1 on each reciprocal movement of dressing tool 5 or 6. To this end, a contact pressure of the dressing tool 5 or 6 with the honing wheel 1 is constantly maintained and the established pressure between the dressing tool 5 or 6 and the honing wheel 1 is detected using a suitable sensor (not shown). The transverse feed of dressing tool 5 or 6 is repeated until a predetermined total in-feed distance is reached. The total number of transverse feeds of the dressing tool 5 or 6 according to the present invention has been found to be less than that of the prior art (see FIG. 11). As a result, the amount of material removed from honing wheel 1 is greater than that of the prior art resulting in a more efficient honing operation.

As illustrated in FIG. 10, the in-feed of honing wheel 1 includes two stages. The first stage is a large in-feed stage in which a relatively large distance per transverse stroke is covered. The second stage is a small in-feed stage in which a relatively small distance per transverse stroke is covered. During the small in-feed operation, a constant distance is traveled by honing wheel 1, as opposed to a gradually increasing distance as previously described.

The conventional dressing tool with diamond as dressing material is used in this embodiment.

Although the present invention has been fully described in connection with the preferred embodiment thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A method of dressing a hone in a honing wheel rotatably supported on a casing for honing a gear to be finished by means of a dressing tool secured on a table, said method comprising the steps of:

rotating said honing wheel using a motor on said casing;

bringing said honing wheel to be dressed into pressure contact with said dressing tool, said pressure contact step including sliding said casing in an in-feed direction relative to said table;

feeding said dressing tool transversely across a surface of said hone in said honing wheel, said feeding step including reciprocating said table in a transverse feed direction;

establishing and maintaining said feeding of said dressing tool with said hone in a first in-feed stage concurrent with said reciprocating of said table in the transverse feed direction, wherein said hone in said honing wheel is elastically deformed during said first in-feed stage, and an in-feed distance is gradually increased; and maintaining said feeding of said dressing tool with said hone in a second in-feed stage, wherein said in-feed distance is held constant following said first in-feed stage.

2. A method of dressing a hone, comprising the steps of:

providing a honing wheel rotatably supported on a casing and having a motor operatively connected thereto for honing a gear to be finished, said step of providing said honing wheel including providing a dressing tool secured on a table;

rotating said honing wheel;

sliding said casing in an in-feed direction relative to said table;

moving said hone of said honing wheel into pressure contact with said dressing tool; and feeding said dressing tool transversely across a surface of said hone in said honing wheel while reciprocating said table in a transverse feed direction, said step of feeding said dressing tool including the steps of:

feeding said dressing tool during a first in-feed stage concurrent with said reciprocating of said table in the transverse feed direction, wherein said hone in said honing wheel is elastically deformed and an in-feed distance is gradually increased, and feeding said dressing tool during a second in-feed stage following said first in-feed stage, wherein said in-feed distance is held constant.

* * * * *